US005908259A

United States Patent [19]

Johnson

[11] Patent Number: 5,908,259

[45] **Date of Patent: *Jun. 1, 1999**

[54] INDEX SHEET ASSEMBLY

[75] Inventor: Lynne B. Johnson, St. Louis, Mo.

[73] Assignee: American Trading and Production Corporation, Baltimore, Md.

[ * ] Notice: This patent is subject to a terminal disclaimer.

[21] Appl. No.: 08/890,823

[22] Filed: Jul. 10, 1997

[51] Int. Cl.[6] ..... B42F 13/00

[52] U.S. Cl. ..... 402/79; 281/38; 283/36

[58] Field of Search ..... 281/38; 402/79; 283/36, 37, 38, 39, 40, 41, 42

[56] References Cited

U.S. PATENT DOCUMENTS

| | | | |
|---|---|---|---|
| 5,299,879 | 4/1994 | Burrow | 402/79 |
| 5,333,908 | 8/1994 | Dorney et al. | 402/79 X |
| 5,447,336 | 9/1995 | Deighton | 402/79 X |
| 5,503,435 | 4/1996 | Kline | 402/79 X |

*Primary Examiner*—Willmon Fridie, Jr.
*Attorney, Agent, or Firm*—Cohn, Powell & Hind, P.C.

[57] ABSTRACT

This indexing system (10) for use with a binder (12) includes a plurality of section divider sheets (14) each having an outstanding tab (16) with index indicia thereon and a foldout index sheet assembly (18). The assembly (18) is formed from a unitary foldable sheet which includes a carrier portion (20) and a foldout index portion (22) provided with index indicia corresponding to the indicia on the tabs.

14 Claims, 3 Drawing Sheets

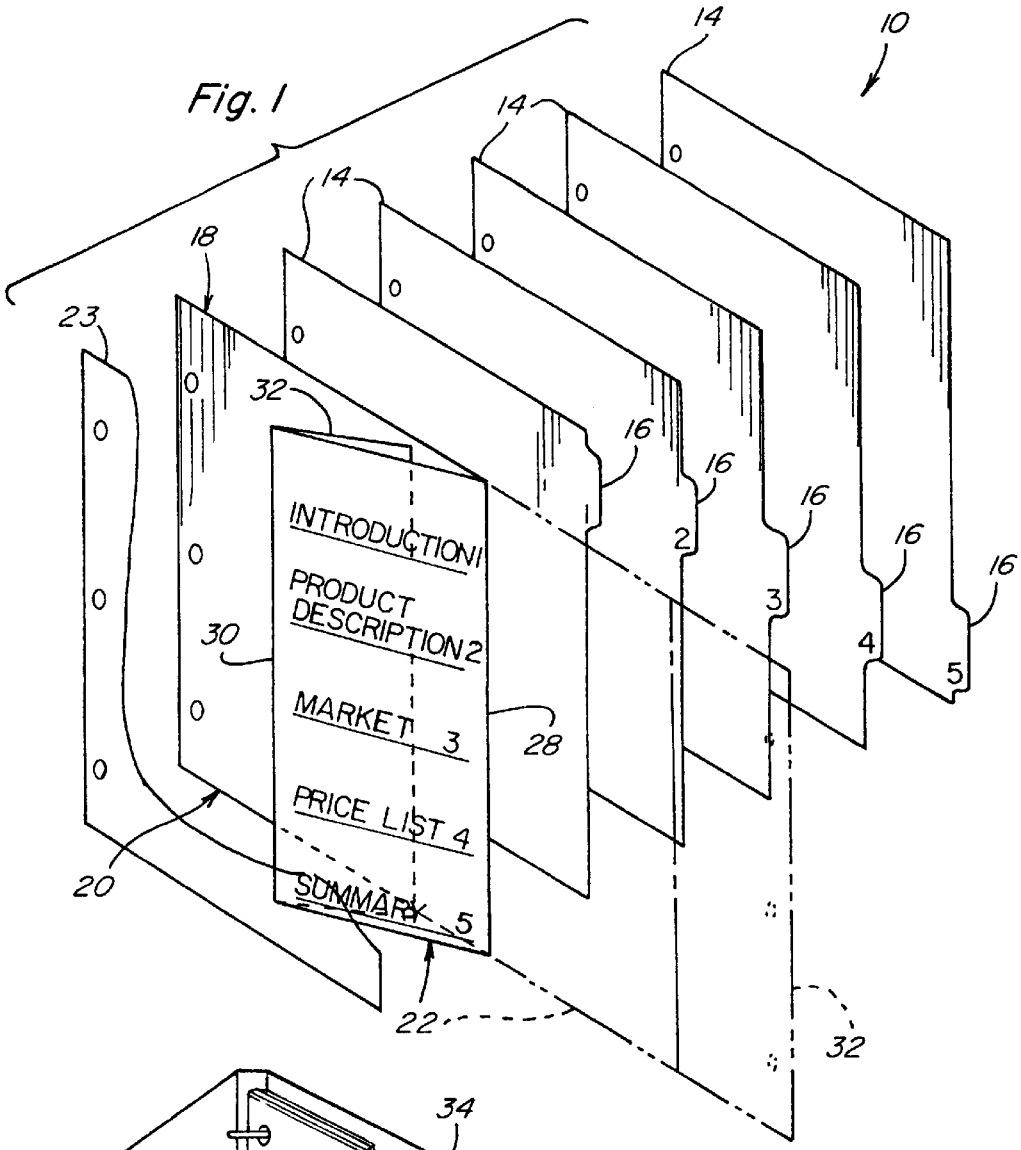
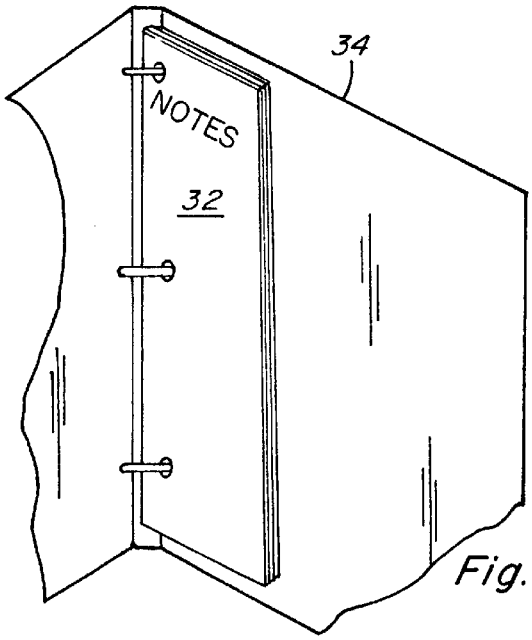
Fig. 4

INDEX SHEET ASSEMBLY

BACKGROUND OF THE INVENTION

This invention relates generally to index sheets for binders and more particularly to an index sheet which can be moved into a visible position for review.

There are several ways of indexing binders, the most common probably being the provision of index information directly on tabs attached to section divider sheets. Another indexing system, which is more convenient, provides the divider tabs with indexing indicia such as sequential numerals or letters and an index sheet which provides corresponding indicia and related index information aligned with the divider tabs. The latter system works well but suffers from the disadvantage that when the binder is open at a particular section the index sheet is hidden. Systems have been devised to provide index sheets which can be moved into a viewing position.

The closest known reference is commonly-owned U.S. Pat. No. 5,299,879, which discloses an indexing system for use with a binder having a plurality of section divider sheets each having an outstanding tab with index indicia thereon and a foldout index sheet assembly. The assembly disclosed in U.S. Pat. No. 5,299,879 includes a carrier sheet and a foldable index sheet provided with index indicia corresponding to the indicia on the tabs and attachable to the carrier sheet. This system permits the use of a foldable index sheet adhesively attached to a carrier sheet of the same size to facilitate use in conjunction with a copying machine of standard size.

The present system overcomes this limitation and other disadvantages in a manner not revealed in the known prior art.

SUMMARY OF THE INVENTION

This invention provides an index system which can be folded out from a binder for review when the binder is open and can be readily folded into a non-viewing position within the binder when not required.

This indexing system for a binder, comprises a plurality of section divider sheets each having a tab with index indicia thereon, and an index sheet assembly including a carrier sheet and a foldable index sheet defined by a longitudinal fold line, the index sheet having a sequence of index indicia corresponding to the index indicia on said tabs of said section divider sheets, the index sheet being attached to the canier sheet by being continuously formed with the carrier sheet, so that the index sheet is foldable out for review.

It is an aspect of the invention to provide that the carrier sheet and the index sheet are formed from a unitary sheet.

It is another aspect of this invention to provide that the carrier sheet and the index sheet, are of different width.

It is still another aspect of this invention to provide that the fold line divides the continuous sheet into a carrier sheet having substantially the same width as the overall width of the divider sheet excluding the tab and an index sheet having a width at least as great as the carrier sheet.

It is yet another aspect of this invention to provide that the index sheet is narrower than the carrier sheet.

It is another aspect of this invention to provide that the index sheet includes an outwardly disposed foldable portion reversely foldable against the portion attached to the carrier sheet.

It is yet another aspect of this invention to provide that the index sheet includes an outwardly disposed portion providing a note storage portion.

It is still another aspect of this invention to provide that the index sheet includes an outwardly disposed portion defined by a tear line and providing a removable note storage portion.

It is an aspect of this invention to provide that the carrier sheet includes an inner end having a plurality of longitudinally arranged binder ring receiving openings, and the index sheet includes an outwardly disposed foldable portion reversely foldable against the portion attached to the carrier sheet and having a longitudinal end margin spaced from said openings.

It is an aspect of this invention to provide that the index sheet has first and second portions defined by a longitudinal fold line, the first portion having a sequence of index indicia on one side of the fold line corresponding to the index indicia on said tabs of said section divider sheets, and placeable in register with said index indicia on said tabs, and attachment means attaching the second portion to the carrier sheet so that said first portion is foldable out for review, the attachment means being provided by continuously forming the index sheet and the carrier sheet.

It is an aspect of this invention to provide an indexing system for a binder or book, comprising a plurality of section divider sheets each having a tab with index indicia thereon, and a unitary foldable sheet including a carrier portion and an index portion formed with said carrier portion, said index portion having a sequence of index indicia corresponding to the index indicia on said tabs of said section divider sheets, and placeable in register with said index indicia on said tabs, said index portion being foldable relative to said carrier portion so that it can be unfolded from a storage position overlapping said carrier portion to a review position extending outwardly of said carrier portion.

It is yet another aspect of this invention to provide that the foldable sheet is initially 17"×11".

It is still another aspect of the invention to provide that the carrier portion is the same width as the overall width of the divider sheets excluding the tabs and that the index portion extends outwardly beyond said tabs.

This indexing system is inexpensive to manufacture, simple to use and efficient in operation.

BRIEF DESCRIPTION OF THE DRAWINGS

FIG. 1 is a perspective, exploded view of the indexing system;

FIG. 4 is a perspective, fragmentary view showing the storage of a note portion of the index sheet in a binder.

DESCRIPTION OF THE PREFERRED EMBODIMENT

Figure 2:
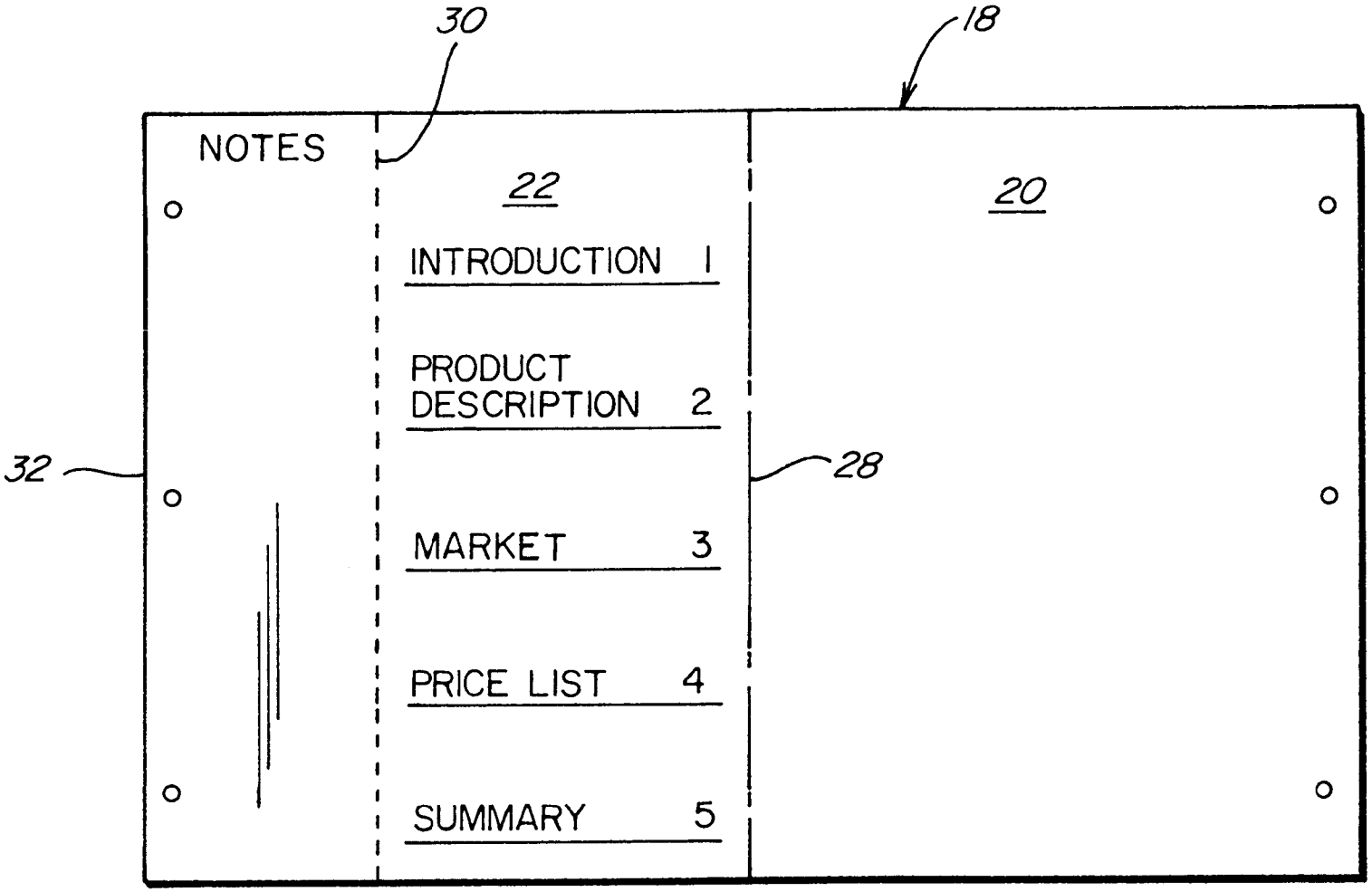
FIG. 2 is an elevational view showing the index sheet assembly.
Figure 3:
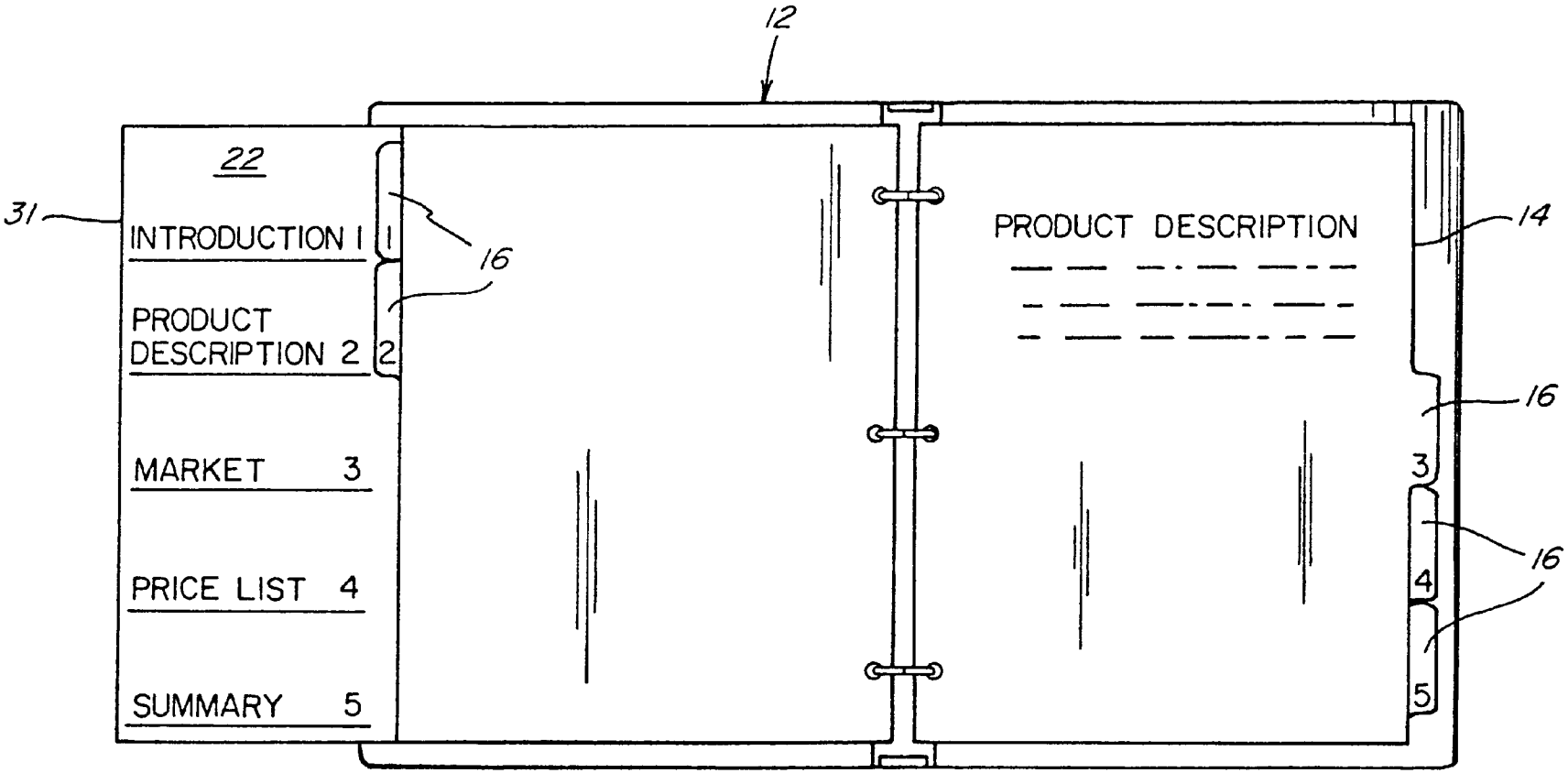
FIG. 3 is an elevational view showing the folded out index sheet in use.

Referring now by reference numerals to the drawings and first to FIGS. 1–3 it will be understood that in the embodiment shown the indexing system 10 is intended for use in a binder such as the three-ring binder 12 and includes a plurality of section divider sheets 14 for separating the information in the binder into sections having appropriate headings. For example, a binder which includes promotional material for a new product could have "Table of Contents" information such as Introduction, Product Description, Marketing, etc.

In the embodiment shown, each of the divider sheets 14 includes a tab 16 sequentially located and carrying indexing indicia such as numerals 1,2 etc. Except for the location and indicia on the tabs the divider sheets 14 are identical and, in the preferred embodiment are of a standard typing sheet size such as 8–½"×11".

The indexing system includes an index sheet assembly 18, constituting an index sheet means and consisting of a carrier sheet 20 unitarily formed with a foldable index sheet 22. This index sheet 22 is defined by a longitudinal fold line 28, and includes a first portion on one side of the fold line carrying a sequence of indicia, and a second portion disposed at or immediately on the other side of the fold line effectively attached to the carrier sheet 20 by being continuously formed with said carrier sheet. As shown in FIG. 3, the index indicia corresponds to the index indicia on the tabs 16 and may be disposed at substantially the same longitudinal or vertical spacing as the indicia on said tabs. The index sheet 22 and the carrier sheet 20 in the embodiment shown are unitarily formed from two halves of a single sheet 18. The index sheet 22 is foldable relative to said carrier sheet 20 so that it can be unfolded from a storage position overlapping said carrier sheet 20 to a review position extending outwardly of said carrier sheet 20. This arrangement provides, for example, two 8½"×11" sheets formed from a single 17"×11" sheet. The attachment between the two sheets is provided by the continuity of the index sheet 22 and the carrier sheet 20. In this arrangement, the first portion of the index sheet 22, extending up to the fold line, and the second portion is attached to the carrier sheet 20 at the other side of the fold line 28. With this arrangement, the index sheet 22 is essentially on one side of the fold fine 28 and the carrier sheet 20 on the other side. The index indicia on the first portion of the index sheet is perpendicularly or horizontally aligned and in register with the corresponding index indicia on the tabs 16. Because the second portion of the index sheet is attached to the carrier sheet 20 by continuity between the index sheet 22 and the carrier sheet 20 the index sheet is foldable outwardly to provide a review extension index sheet which is visible when the binder is open at any section as indicated, for example, in FIG. 3.

It is useful to provide a conventional, non-foldable index sheet, indicated by numeral 23 in FIG. 1, in addition to the foldable index sheet 22. As shown, the conventional index sheet 23 is disposed ahead of said foldable index sheet 22 and bears the identical information (not shown) as said index sheet 22. In those instances in which multiple copies of the foldable index sheet are required for multiple binders it has been found advantageous to provide guide lines and index indicia on master sheets printed in light blue or some other color which does not copy on a photocopy machine. When this is done the necessary index information can be typed on the master sheet and prepunched index sheets bearing the preprinted index indicia 1,2, etc. can be used for the actual copies.

In the embodiment shown, the index sheet 22 and the carrier sheet 20 are substantially the same size. Because of this, the index sheet is preferably reversely folded about a fold line 30 so that it has a shorter width than the carrier sheet and, in addition provides a "note" portion 32. This arrangement provides that the index sheet outer folded margin is short of the binder rings and ring openings so that there is no problem of interference between the index sheet and the binder rings.

In the preferred embodiment the width of the carrier sheet is substantially equal to the width of the divider sheet excluding the tab.

As an alternative to having a reversely folded portion of the index sheet, it may be preferred to make the fold line 30 a tear line. With this arrangement, the folded note portion 32 can be provided with binder ring openings used for notes and memos and removed along the tear line 30 so that it can be stored in a separate binder 34 shown in FIG. 4.

As another alternative, the index sheet may simply be made of a different width than the carrier sheet, for example, narrower than the carrier sheet or wider than the carrier sheet. If made narrower than the carrier sheet, the need for a tear sheet may be avoided and the Line 31, shown in FIG. 3 is a cut margin, so that the index sheet when folded will be conveniently spaced from the rings of the binder which accomplishes the same end as the fold line 30 shown in FIG. 1. If made wider than the carrier sheet, the index sheet may simply be multi-folded to fit within the binder.

In view of the fact that many users of the index sheet assembly 18 have access to a copier machine which will copy large sheets such as 17"×11", this particular arrangement complements the index sheet assembly 18 shown in U.S. Pat. No. 5,299,879, which can be used with smaller sheets such as 8½"×11".

In both cases, whether the index sheet 22 and the carrier sheet 20 are attached by adhesive as shown in U.S. Pat. No. 5,299,879 or by continuity, as shown herein, the index sheet assembly 18 is used in exactly the same way following installation in a binder 12. In each case, it is simply a matter of unfolding the index sheet 20 to the position shown in FIG. 3. When this is done the tabs 16 are lined up with the indicia on the index sheet 22 and divider sheet 14 bearing the tab 16 corresponding to the indicia section which it is desired to view and the binder 12 can readily be opened to that section.

With the binder 12 open and the index sheet 22 in the foldout position, as shown in FIG. 3, it is a simple matter for the reader to move to another section location by flipping the appropriate section divider tab 14 horizontally aligned with the corresponding index sheet information.

It will be understood that while a loose leaf binder is described the invention can be used with a permanent book binder, a spiral binder and any temporary or permanent binding system. Further, it will also be understood by those skilled in the art that the sheet size is not limited to 8½"×11" and 17"×11" conventional paper size. It can also be used with any sheet size which provides an index sheet portion which is visible when folded out, for example, paper having a height of 11" paper having the width ranging from say 13"–16". In addition, it will be clear to those skilled in the art that the invention can readily be adapted to A4 (European) paper size. Thus, the invention is used with a sheet whose initial width is greater than the width of the divider sheet including the tab so that a useable outstanding index sheet portion is provided.

In view of the above it will be seen that various aspects and features of the invention are achieved and other advantageous results attained. While a preferred embodiment of the invention has been shown and described, it will be clear to those skilled in the art that changes and modifications may be made therein without departing from the invention in its broader aspects.

I claim as my invention:

1. An indexing system for a binder, comprising:

a plurality of section divider sheets each having a tab with index indicia thereon, and an index sheet assembly including a carrier sheet and a foldable index sheet defined by a longitudinal fold line, said index sheet having a sequence of index indicia corresponding to the index indicia on said tabs of said section divider sheets, said index sheet being attached to said carrier sheet, by being continuously formed with said carrier sheet, so that said index sheet is foldable out for review.

2. An indexing system as defined in claim 1, in which:

said carrier sheet and said index sheet, are of a different width.

3. An indexing system as defined in claim 1, in which:

the fold line divides the continuous sheet into a carrier sheet having the same width as the overall width of the divider sheet excluding the tab and an index sheet having a width at least as great as the carrier sheet.

4. An indexing system as defined in claim 2, in which:

said index sheet is narrower than the carrier sheet.

5. An indexing system as defined in claim 1, in which:

the index sheet includes an outwardly disposed foldable portion reversely foldable against the portion attached to the carrier sheet.

6. An indexing system as defined in claim 1, in which:

said index sheet includes an outwardly disposed portion providing a note storage portion.

7. An indexing system for a binder, comprising:

a plurality of section divider sheets each having a tab with index indicia thereon, an index sheet assembly including a carrier sheet and a foldable index sheet defined by a longitudinal fold line, said index sheet having a sequence of index indicia corresponding to the index indicia on said tabs of said section divider sheets, said index sheet being attached to said carrier sheet, by being continuously formed with said carrier sheet, so that said index sheet is foldable out for review; and said index sheet including an outwardly disposed portion defined by a tear line and providing a removable note storage portion.

8. An indexing system as defined in claim 1, in which:

said carrier sheet includes an inner end having a plurality of longitudinally arranged binder ring receiving openings, and said index sheet includes an outwardly disposed foldable portion reversely foldable against the portion attached to the carrier sheet and having a longitudinal end margin spaced from said openings.

9. An indexing system for a binder, comprising:

a plurality of section divider sheets each having a tab with index indicia thereon, and an index sheet assembly including a carrier sheet and a foldable index sheet having first and second portions defined by a longitudinal fold line, said first portion having a sequence of index indicia on one side of the fold line corresponding to the index indicia on said tabs of said section divider sheets, and placeable substantially in register with said index indicia on said tabs, and attachment means for attaching said second portion to said carrier sheet so that said first portion is foldable out for review, said attachment means being provided by continuously forming said index sheet and said carrier sheet.

10. An indexing system for a binder, comprising:

a plurality of section divider sheets each having a tab with index indicia thereon, and a unitary foldable sheet including a carrier portion and an index portion formed with said carrier portion, said index portion having a sequence of index indicia corresponding to the index indicia on said tabs of said section divider sheets, and placeable substantially in register with said index indicia on said tabs, said index portion being foldable relative to said carrier portion so that it can be unfolded from a storage position overlapping said carrier portion to a review position extending outwardly of said carrier portion.

11. An indexing system as defined in claim 10, in which:

said carrier portion is substantially one-half of the size of the foldable sheet.

12. An indexing system as defined in claim 10, in which:

said carrier portion and the index portion are each, at least initially, substantially one-half of the size of the foldable sheet.

13. An indexing system as defined in claim 10, in which:

the foldable sheet is initially 17"×11".

14. An indexing system as defined in claim 10, in which:

the canier portion is the same width as the overall width of the divider sheets excluding the tabs and the index portion extends outwardly beyond said tabs.

* * * * *